United States Patent [19]

Lück

[11] Patent Number: 4,496,880

[45] Date of Patent: Jan. 29, 1985

[54] FLUORESCENT LAMP BALLAST

[76] Inventor: Harald Lück, Cheruskerweg 56, 6000 Frankfurt/M 80, Fed. Rep. of Germany

[21] Appl. No.: 391,717

[22] Filed: Jun. 24, 1982

[51] Int. Cl.[3] ..... H05B 37/00

[52] U.S. Cl. ..... 315/228; 315/232; 315/247; 315/276; 315/278

[58] Field of Search ..... 315/247, 276, 278, 228, 315/232

[56] References Cited

U.S. PATENT DOCUMENTS

| | | | |
|---|---|---|---|
| 2,268,512 | 12/1941 | McCarthy | 315/247 |
| 2,436,399 | 2/1948 | Nathanson | 315/247 |
| 3,029,363 | 4/1962 | Mauerer | 315/228 |
| 3,125,705 | 3/1964 | Feinberg et al. | 315/278 |
| 3,141,112 | 7/1964 | Eppert | 315/247 |
| 3,463,964 | 8/1969 | Privett et al. | 315/247 |
| 4,010,399 | 3/1977 | Bessone et al. | 315/101 |
| 4,211,957 | 7/1980 | Alley | 315/247 |

FOREIGN PATENT DOCUMENTS

| | | | |
|---|---|---|---|
| 898577 | 6/1962 | United Kingdom | 315/247 |

OTHER PUBLICATIONS

"Fluorescent Lamps" by General Electric (5 miscellaneous pp.).

*Primary Examiner*—Harold Dixon

*Attorney, Agent, or Firm*—Toren, McGeady and Stanger

[57] ABSTRACT

A ballast for energizing a pair of fluorescent lamps in response to power supplied by an AC line, includes a capacitor connected between one of a pair of heater winding leads which connect to a filament contained in one of the fluorescent lamps, and one of a pair of leads associated with a primary winding of the ballast, the primary winding leads being connected to the AC line. The present ballast realizes a substantial reduction in the amount of power consumed from the AC line when compared to operation of the ballast without the added capacitor.

3 Claims, 2 Drawing Figures

FLUORESCENT LAMP BALLAST

BACKGROUND OF THE INVENTION

The present invention relates generally to electrical ballasts for energizing vapor lamps, and particularly to a ballast which may be used to energize a number of fluorescent lamps when powered by an AC line, but which exhibits substantially less power loss than the known, conventional ballasts.

Conventional ballasts such as, for example, type 446-LR-TC-P, manufactured by Universal Ballast Engineering, include a core about which a first winding arrangement is provided for connection to a 117 VAC (nominal) line, to produce exciting voltage and operating current for a pair of fluorescent lamps (e.g., a pair of 40 watt, type F40-T12/RS lamps). The first winding arrangement usually forms an autotransformer wherein a primary winding has a pair of leads for connection to the AC line, and a secondary winding is connected at one end to the primary winding and at the other end to a power factor correction capacitor which is typically about 3.7 to 4 microfarads. The conventional ballast also includes a second winding arrangement, including typically three separate filament heater windings for connection to filament heaters contained at each end of each of the fluorescent lamps. The remaining terminal of the power factor correction capacitor then is connected to one lead of one of the heater windings, and the same heater winding lead also is coupled to a lead of a different heater winding by a starter capacitor which is typically 0.05 microfarads.

AC power measurements at the primary winding of the type 446-LR-TC-P ballast reveal that with an AC line voltage of 117 volts, the ballast consumes 92 watts, while a pair of type F40-CW-T12/RS fluorescent lamps wired to the ballast emit 62 foot-candles of light at one meter distance on center. Inasmuch as a pair of 40 watt lamps ideally should consume only 80 watts of power, it will be understood that the additional 12 watts (92 minus 80) measured at the primary winding of the conventional ballast represents an appreciable power loss.

SUMMARY OF THE INVENTION

An object of the invention is to provide a ballast for a fluorescent lamp system, which ballast consumes less power than conventional ballasts when operating a number of fluorescent lamps, so as to increase the amount of light produced by the lamps per unit of power supplied to the ballast by the AC line.

The present invention represents an improvement in the conventional type of ballast by providing means coupled between one of the pair of leads of the first winding arrangement in the ballast, which leads are connected to the AC line, and one of the pair of leads of the second winding arrangement which leads are connected to a filament heater in one of the fluorescent lamps, said means reducing the AC power supplied to the first winding arrangement by the AC line at a given AC line voltage, and increasing the amount of light produced by the fluorescent lamps per unit of the reduced AC power supplied to the first winding arrangement.

For a better understanding of the present invention, reference is made to the following description and accompanying drawing, while the scope of the present invention will be pointed out by the appended claims.

DETAILED DESCRIPTION OF THE INVENTION

Figure 1:
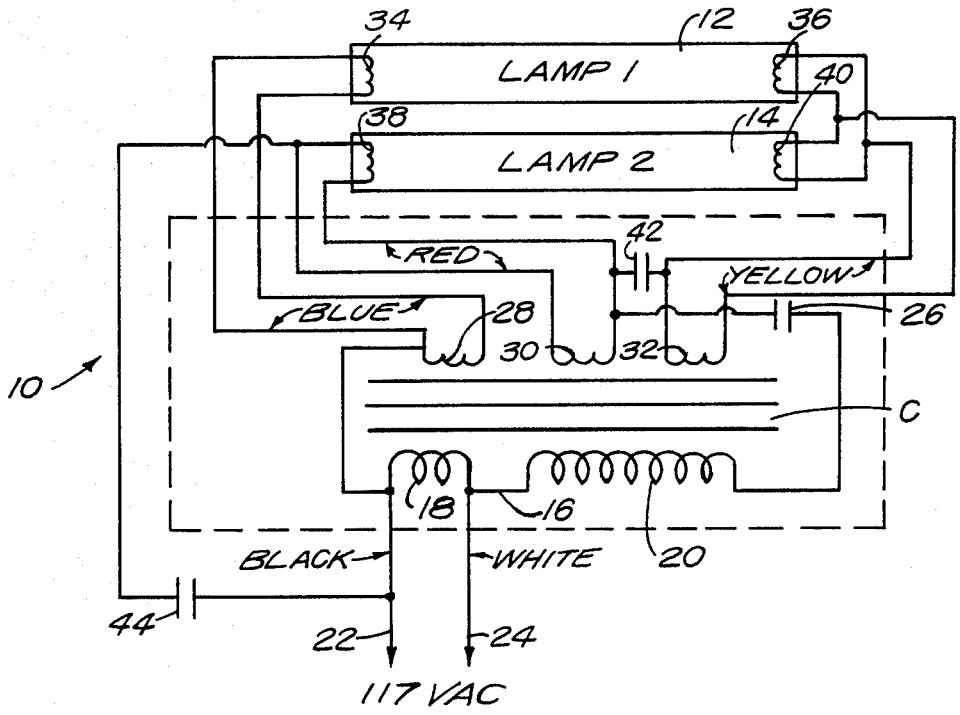
FIG. 1 is an electrical schematic diagram of an improved ballast according to the present invention.

FIG. 1 shows an embodiment of an improved ballast 10 according to the present invention, the ballast 10 being connected to a 117 VAC line for energizing a pair of fluorescent lamps 12 and 14. The portion of the ballast 10 shown within the dotted lines may be a conventional ballast such as, for example, the Universal type 446-LR-TC-P, and includes a first winding arrangement 16 in the form of an autotransformer comprising a primary winding 18 for connection to the 117 VAC line, and a secondary winding 20 for providing exciting voltage and operating current to the lamps 12, 14. The primary winding 18 has an associated pair of leads 22, 24, the lead 22 being color-coded black and the lead 24 being color-coded white in the identified conventional ballast. One end of the secondary winding 20 is connected to the end of the primary winding 18 to which the white lead 24 is connected, and the other end of the secondary winding 20 is connected to one terminal of a power factor correction capacitor 26 of a value which may range from 3.7 to 4 microfarads. The capacitor 26 also may be shunted with a resistor (not shown) of value 2 to 3 megohms.

A second winding arrangement on core C of the ballast 10 in FIG. 1, includes three separate filament heater windings 28, 30 and 32. Each of the heater windings is arranged to provide from about 3.5 to 4.5 VAC for heating filaments 34, 36, 38 and 40 contained at corresponding ends of the fluorescent lamps 12, 14. Also, in the present embodiment, each of the lamps 12, 14 preferably is type F40W-T12/RS, or equivalent.

In the conventional ballast forming part of the circuit in FIG. 1, the heater winding 28 has an associated pair of blue color-coded leads for connection to the filament 34 in lamp 12, and the heater winding 30 has an associated pair of red color-coded leads for connection to the filament 38 in lamp 14. The heater winding 32 has an associated pair of yellow color-coded leads for connection, in parallel, to the filaments 36 and 40 in lamps 12 and 14, respectively.

The remaining terminal of the power factor correction capacitor 26 is connected to one of the leads associated with the heater winding 30 (one of the red color-coded leads), and a starting capacitor 42 is connected between the same lead of the heater winding 30 and one of the yellow color-coded leads associated with the heater winding 32.

In accordance with the present invention, a capacitor 44 of value in the range of from about 0.5 to 0.55 microfarads has one terminal connected to one of the leads associated with the heater winding 30 of the ballast 10 (i.e., either one of the red color-coded leads of the conventional ballast identified above), and the other terminal connected to the lead 22 associated with the primary winding 18 of the ballast 10 (i.e., the black color-coded lead of the identified conventional ballast).

It has been discovered that by connecting the capacitor 44 as shown in FIG. 1, a substantial reduction in the amount of power consumed by the conventional ballast from the AC line is realized, without an equivalent loss in the amount of light emitted by the lamps 12 and 14.

Figure 2:
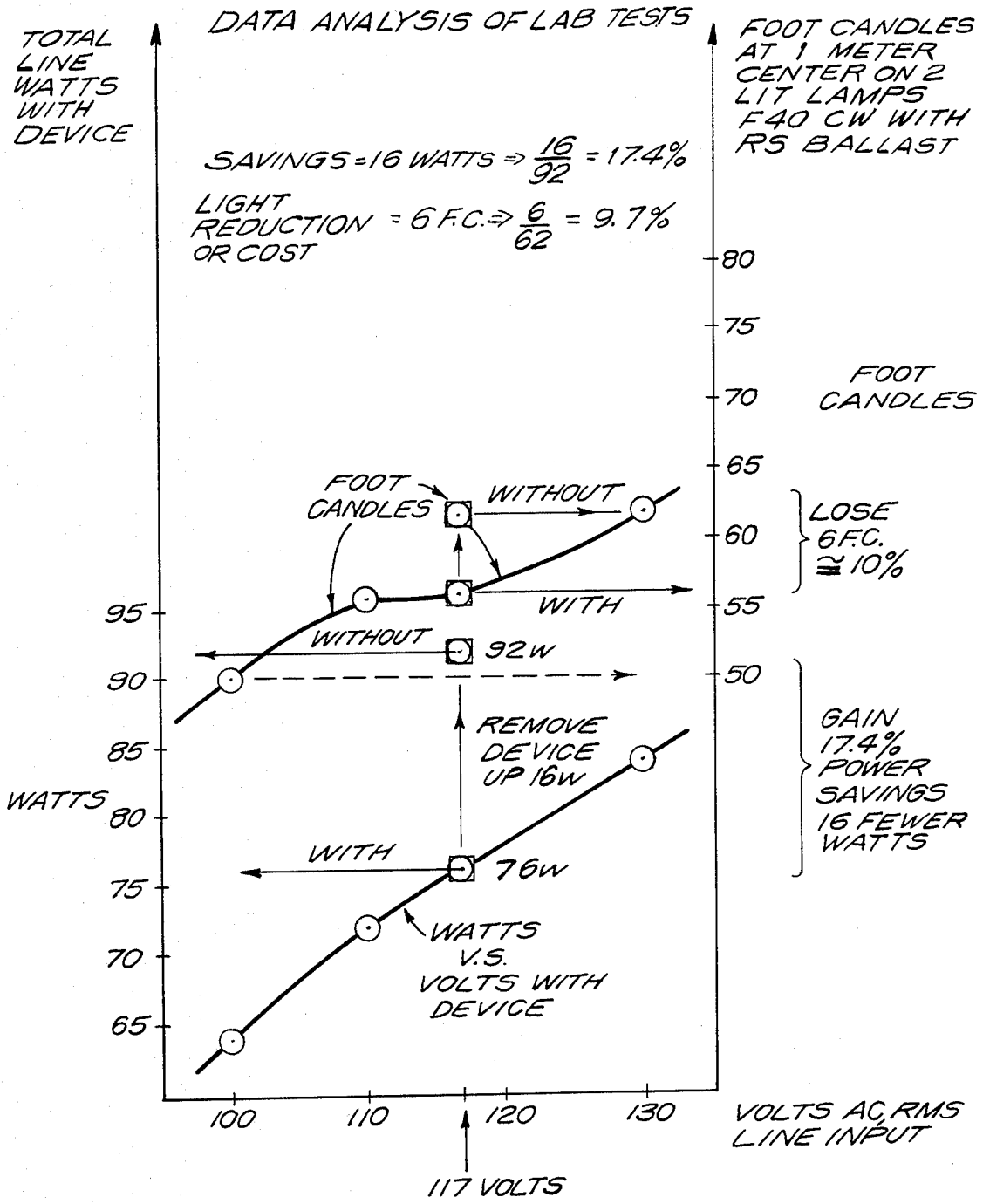
FIG. 2 is a graph illustrating electrical and lighting characteristics of a fluorescent lamp system when using the present ballast as compared to the same characteristics for a conventional ballast.

As shown graphically in FIG. 2, a comparison of the operating characteristics of the ballast 10 when energizing a pair of F40 CW-T12/RS lamps, both with and without the capacitor 44 in FIG. 1, reveals that at a fixed AC line voltage of 117 volts, the power consumption of the ballast 10 is reduced 16 watts, with a loss of only 6 foot-candles of light when the capacitor 44 is in the circuit. This corresponds to a 17.4% savings in power consumption, with an associated light loss of only 9.7%.

Stated differently, the ratio of light emitted by the two lamps as measured at a distance of one meter on center, to the amount of power supplied to the ballast primary winding, increases from 0.67 (62 f.c./92 w.) to 0.74 (56 f.c./76 w.). This amounts to an increase in overall lighting efficiency of more than 10 percent.

It is believed that the reduced power consumption obtained with the present ballast 10 occurs as a result of the capacitor 44 allowing some current which would otherwise flow in series through the lamps 12, 14 and thereby dissipate power, to flow directly back to the AC power line without any dissipation of real power. Further, the conventional ballasts with which the capacitor 44 can be used, limit the total operating current they provide to the lamps 12, 14 (e.g., 460 ma. max., 430 ma. nominal for F40 T12 lamps), so that no additional operating current is supplied to the lamps 12, 14 to compensate for the current returned to the AC line by the capacitor 44 in the ballast 10. Of course, this is only one theory of operation for the ballast 10, and is not intended in any manner to limit the application and scope of the present invention.

While the foregoing description and drawings represent the preferred embodiments of the present invention, it will be obvious to those skilled in the art that various changes and modifications may be made therein without departing from the true spirit and scope of the present invention.

I claim:

1. A fluorescent ballast arrangement comprising:

(a) a conventional ballast including:

a primary winding for connection to the AC line, said primary winding having first and second ends;

a first secondary winding, said first secondary winding having first and second ends, said first end of said secondary winding being connected to the second end of said primary winding to form an autotransformer;

a power factor correction capacitor having a first terminal connected to said second end of said first secondary winding and a second terminal;

second, third and fourth secondary windings for connection to filament heaters contained at each end of each of a pair of fluorescent lamps driven by said ballast, said lamps being series-connected through commonly connected heater windings driven by said third secondary winding, the second terminal of said power factor correction capacitor being connected to one lead of said second heater winding, said one lead of said second heater winding also connected to one lead of said third heater winding by a starter capacitor, said first end of said primary winding also being connected to one lead of said fourth heater winding; and (b) a power reducing capacitor connected effectively across said lamps, said power reducing capacitor being connected between said first end of said primary winding and the other lead of said second heater winding, said power reducing capacitor for reducing the amount of power supplied to the ballast arrangement for a given AC line voltage without reducing the light emitted by the lamps by an amount proportionately as large.

2. The ballast arrangement of claim 1, wherein said power reducing capacitor has a value in the range of from about 0.5 to 0.55 microfarads.

3. The ballast arrangement of claim 1, wherein the power reducing capacitor is external to said conventional ballast.

* * * * *